US005523780A

United States Patent [19]

Hirosawa et al.

[11] Patent Number: 5,523,780

[45] Date of Patent: Jun. 4, 1996

[54] INK JET RECORDING APPARATUS AND INK CARTRIDGE MOUNTABLE ON SAID APPARATUS

[75] Inventors: Toshiaki Hirosawa, Hiratsuka; Yoshifumi Hattori, Yamato; Minoru Nozawa, Machida; Kenji Aono, Kawasaki, all of Japan

[73] Assignee: Canon Kabushiki Kaisha, Tokyo, Japan

[21] Appl. No.: 79,563

[22] Filed: Jun. 22, 1993

[30] Foreign Application Priority Data

Jun. 24, 1992 [JP] Japan ..... 4-166403

[51] Int. Cl.[6] ..... B41J 2/175

[52] U.S. Cl. ..... 347/86; 141/387

[58] Field of Search ..... 347/86, 87, 36; 220/200, 209, 307; 141/346, 387, 388, 389, 391

[56] References Cited

U.S. PATENT DOCUMENTS

| | | | |
|---|---|---|---|
| 2,670,871 | 3/1954 | Spiess, Jr. et al. | 220/307 |
| 4,156,244 | 5/1979 | Erikson et al. | 86/86 |
| 4,162,501 | 7/1979 | Mitchell et al. | 347/86 |
| 4,429,320 | 1/1984 | Hattori et al. | 347/86 |
| 4,447,820 | 5/1984 | Terasawa | 347/86 |
| 4,506,276 | 3/1985 | Kyser et al. | 347/86 |
| 4,608,577 | 8/1986 | Hori | 347/66 |
| 4,680,696 | 7/1987 | Ebinuma et al. | 347/85 |
| 4,700,202 | 10/1987 | Kuranishi et al. | 347/86 |
| 5,283,593 | 2/1994 | Wehl | 347/86 |

FOREIGN PATENT DOCUMENTS

| | | | |
|---|---|---|---|
| 0442485 | 8/1991 | European Pat. Off. | 347/86 |
| 2709730 | 9/1978 | Germany | 347/86 |
| 54-056847 | 5/1979 | Japan . | |
| 60-071260 | 4/1985 | Japan . | |
| 60-58863 | 4/1985 | Japan | 347/86 |
| 1-133749 | 5/1989 | Japan | 347/86 |

*Primary Examiner*—John E. Barlow, Jr.

*Attorney, Agent, or Firm*—Fitzpatrick, Cella, Harper & Scinto

[57] ABSTRACT

An ink jet recording apparatus includes a detachable ink cartridge for storage of the ink to be supplied to a recording head. A joint of an ink supply line in the ink jet recording apparatus to be coupled with an ink outlet portion of the ink cartridge for delivering the ink is loosely fitted to be slidable in a direction crosswise to an axis of the supply line toward a coupling position with the ink outlet portion.

2 Claims, 7 Drawing Sheets

INK JET RECORDING APPARATUS AND INK CARTRIDGE MOUNTABLE ON SAID APPARATUS

BACKGROUND OF THE INVENTION

1. Field of the Invention

The present invention relates to an ink jet recording apparatus comprising an ink cartridge detachable therefrom, and the same ink cartridge mountable thereon.

2. Related Background Art

FIG. 9 is a plan cross-sectional view illustrating the couplings of ink outlet portions of an ink cartridge with ink supply pipes from a recording apparatus according to a conventional example.

Most ink jet recording apparatuses, especially printers of an ink jet system, use an ink cartridge of an ink vessel exchangeable type for the convenience of refilling the ink. Such exchangeable type ink cartridges have the advantages that refilling of the ink is accomplished simply by exchanging the ink cartridge itself, judgment for the refilling amount is unnecessary, and almost no contamination with the ink takes place in refilling the ink. When this ink cartridge is used as shown in FIG. 9, it is necessary to couple an ink cartridge with the supply line for supplying the ink within the ink cartridge to an ink jet recording head, which is typically performed by using needles. However, with this method of using needles, protection from the needle point must be secured, whereby a needle point cover or cap must be provided for covering the needle point after the ink cartridge is detached.

On the other hand, as disclosed in U.S. Pat. No. 4,680,696, a method has been proposed in which an ink supply tube connecting member on the apparatus side is displaceably attached by means of a leaf spring member to enhance the reliability in mounting the ink cartridge.

However, these constitutions have resulted in a larger apparatus, increased costs due to an increased number of parts, or complexity in manufacturing the apparatus, because for example, the former must provide a needle point cover and use a mechanism for opening or closing the needle point cover, while the latter is required to have a space for attaching a leaf spring member.

By the way, the constitution of using needles to couple the ink supply pipe is provided with safety covers for greater safety, but more preferably, it has been proposed that without using any needles, the ink cartridge is coupled using hard pipes.

However, this coupling method of using pipes has the drawback that the force required to mount the ink cartridge may become great, because of blunt pipe tips, wherein a method is taken of opening coupling holes in coupling portions of the ink cartridge to reduce this force required to mount the cartridge.

However, such method had a problem that the coupling hole of the coupling portion in the ink cartridge must be in full alignment with the junction position of the ink supply line. In particular, when a plurality of coupling portions were provided within one ink cartridge, such alignment was difficult.

That is, when only one coupling portion is provided, misalignment of the coupling portion is not significant, but when a plurality of coupling portions are provided within one ink cartridge, individual deviation might have already taken place in each coupling portion at the manufacturing, and the amount of deviations may become greater when mounting the ink cartridge. To assure better coupling performance for such plurality of coupling portions in the above way, extremely high precisions of manufacturing will be required.

SUMMARY OF THE INVENTION

The present invention has reviewed an ink jet recording apparatus as a whole to resolve the above-mentioned problems, while taking into consideration the easiness of handling an ink cartridge. A main object of the present invention is to provide an ink jet recording apparatus comprising an ink cartridge of exchangeable type wherein coupling of the ink cartridge with an ink supply line of recording apparatus can be performed reliably, easily and safely.

It is another object of the present invention to provide an ink jet recording apparatus having an ink cartridge detachable therefrom for storage of the ink to be supplied to a recording head. A joint of an ink supply line of the ink jet recording apparatus to be coupled with an ink outlet portion of the ink cartridge for delivering the ink is loosely fitted to be slidable in a direction crosswise to an axis of said supply line toward a coupling position with said ink outlet portion.

It is another object of the present invention to provide an ink cartridge, detachable from an ink jet recording apparatus, for storage of the ink to be supplied to a recording head. An ink outlet portion for delivering the ink from the ink cartridge to be inserted into a joint of an ink supply line of the ink jet recording apparatus is loosely fitted in an ink cartridge container to be slidable in a direction crosswise to an axis of said supply line toward a coupling position with the joint of said ink supply line.

It is another object of the present invention to provide an ink jet recording apparatus comprising a detachable ink cartridge for storage of the ink to be supplied to a recording head. Either one or both of an ink cartridge container and an ink supply line fixing board is or are loosely fitted so that either one of an ink-outlet portion of the ink cartridge for delivering the ink from the ink cartridge and a joint of an ink supply line of the ink jet recording apparatus to be coupled with said ink outlet portion may be slidable in a direction perpendicular to an axis of said supply line toward a coupling position.

Where an ink cartridge container is provided with a void to make an ink outlet portion having an ink bag connected thereto slidable in the directions perpendicular to an axis of the container, even if an ink supply pipe fixed in the ink jet recording apparatus is deviated off the center of the ink outlet portion by a minor amount, coupling of the ink supply pipe and the coupling member can be easily accomplished in such a way as to move the ink cartridge toward the ink supply pipe to first bring a conical portion of the outlet portion into contact with a tip end of the pipe, and thereafter allow the outlet portion to slide in a direction into the void within the container by advancing the tip end of the pipe along the conical portion thereof.

On the contrary, where a pipe fixing board is provided with a void to make a supply pipe support member slidable, without any void within the ink cartridge container, the same relative movement as described above allows an easy coupling of the ink supply pipe with the coupling member.

DETAILED DESCRIPTION OF THE PREFERRED EMBODIMENTS

The embodiments of the present invention will be described below with reference to the drawings.

Figure 1:
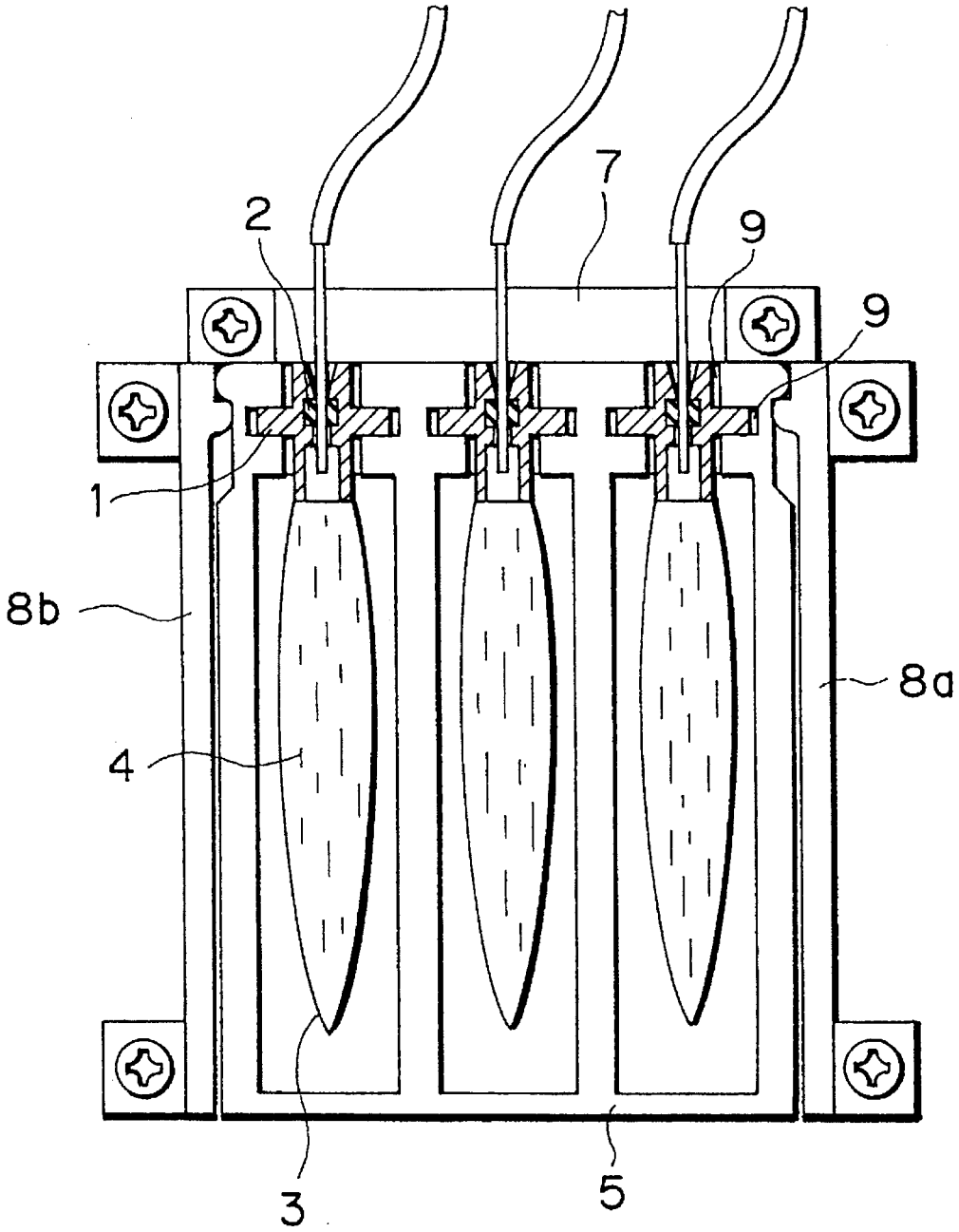
FIG. 1 is a plan cross-sectional view illustrating the couplings of ink outlet portions slidable in a cartridge with ink supply pipes in an ink jet recording apparatus according to an embodiment of the present invention.

FIG. 1 is a plan cross-sectional view illustrating the couplings of ink outlet portions slidable in an ink cartridge with ink supply pipes of an ink jet recording apparatus according to an embodiment of the present invention.

Figure 2A:
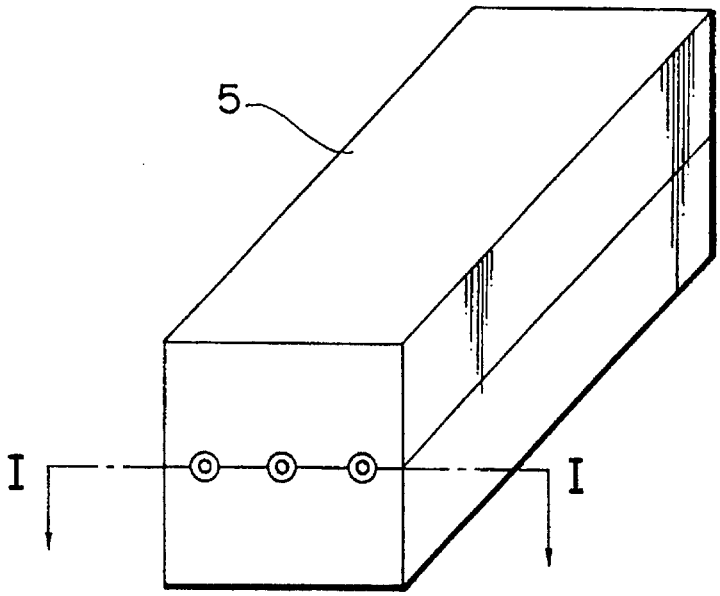
FIG. 2A is a perspective view of an ink cartridge container in FIG. 1.
Figure 2B:
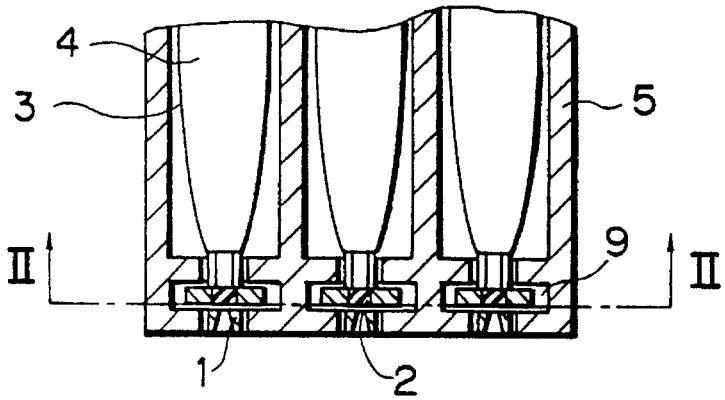
FIG. 2B is a cross-sectional view taken along the line I—I in FIG. 2A.
Figure 2C:
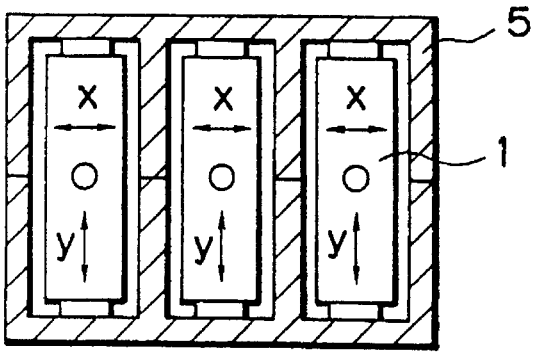
FIG. 2C is a cross-sectional view taken along the line II—II in FIG. 2B.

FIG. 2A is a perspective view of an ink cartridge container in FIG. 1, FIG. 2B is a cross-sectional view taken along the line I—I in FIG. 2A, and FIG. 2C is a cross-sectional view taken along the line II—II in FIG. 2B.

Figure 3A:
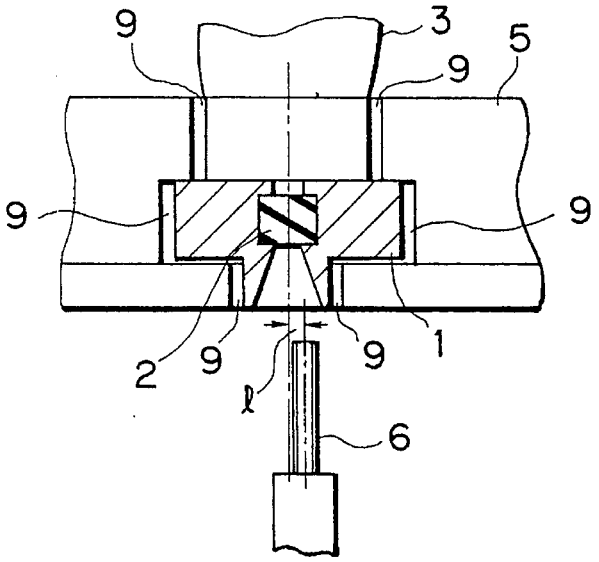
FIGS. 3A, 3B and 3C are plan cross-sectional views illustrating the states before coupling operation, during coupling operation, and after completion of coupling operation, respectively, in a process of coupling one ink cartridge with an ink supply pipe.
Figure 3B:
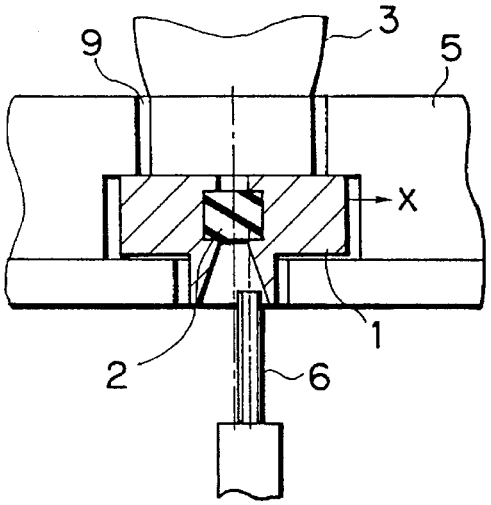
Figure 3C:
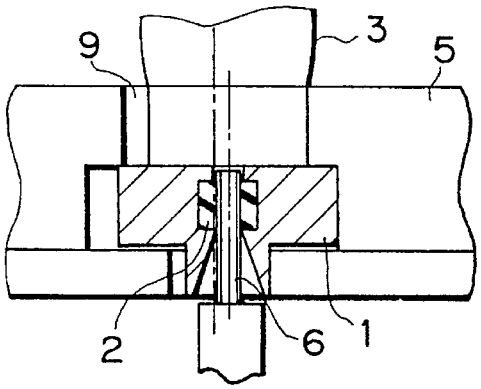

FIGS. 3A, 3B and 3C are plan cross-sectional views illustrating the states before coupling operation, during coupling operation, and after completion of coupling operation, respectively, in a process of coupling one ink cartridge with an ink supply pipe.

Figure 4:
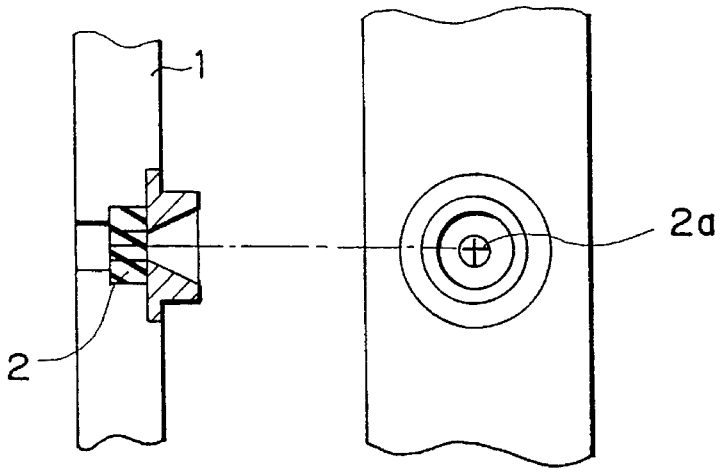
FIG. 4 is a plan cross-sectional view and an elevational view illustrating a slit 2*a* provided in a coupling member 2 of the ink cartridge according to this embodiment.

FIG. 4 is a plan cross-sectional view and an elevational view illustrating a slit 2*a* provided in a coupling member 2 of the ink cartridge in this embodiment.

Figure 5:
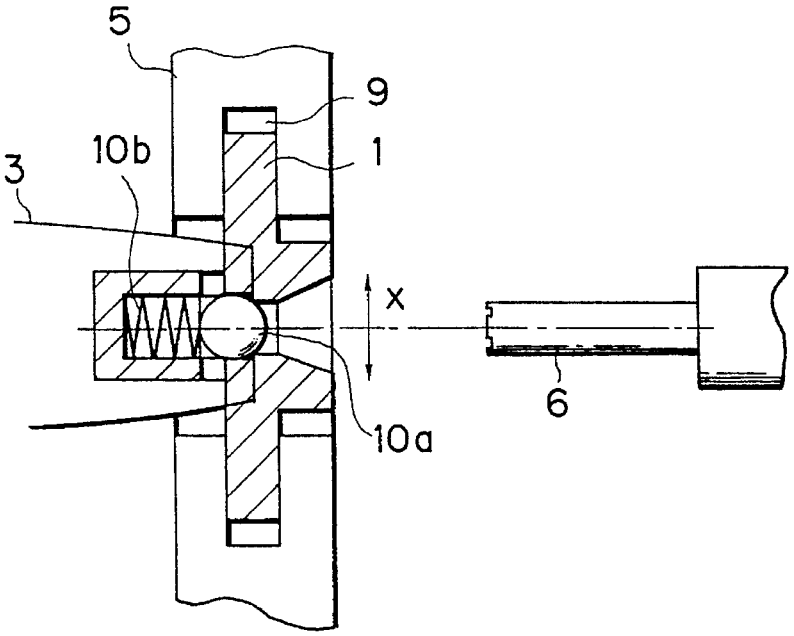
FIG. 5 is a plan cross-sectional view of a coupling and a plan view of a supply pipe where a ball valve is provided in the ink outlet portion 1 of the ink cartridge according to this embodiment.

FIG. 5 is a plan cross-sectional view of a coupling and a plan view of the supply pipe where a ball valve is provided in the ink outlet portion 1 of the ink cartridge in this embodiment.

The ink cartridge container 5 is provided with a void 9, so that the ink outlet portion 1 may be slidable in the directions perpendicular to an axis of the ink supply pipe 6 in coupling between the ink outlet portion 1 of the ink cartridge 5 for delivering the ink 4 from the ink cartridge 5 and the ink supply pipe 6 of the ink jet recording apparatus to be coupled with the ink outlet portion 1.

An ink bag 3 for storing the ink is formed by folding over itself one sheet of polyethylene film with polyethylene terephthalate adhered thereto, and heat welding its peripheries. At one side of the ink bag 3 is connected an ink outlet portion 1 for delivering the ink 4 within the ink bag 3 to the outside. The ink outlet portion 1 has a coupling member 2 embedded therein into which a supply pipe 6 for supplying the ink to an ink jet recording head (not shown) is inserted. The coupling member 2 is, for example, a cylindrical molded product made of an elastic material such as a rubber, for which a material having less compression set is desirable. The supply pipe 6 is firmly secured at a predetermined position by means of a pipe fixing board 7.

An ink cartridge container 5 serves to accommodate the ink outlet portion 1 of the ink bag 3 at a predetermined position. Left and right guide rails 8*a*, 8*b* serve to guide the ink cartridge container 5 in attaching or detaching it to or from the ink jet recording apparatus. And the ink cartridge container 5 is provided with three ink bags 3, for example.

The coupling operation in this embodiment will be described below with reference to FIG. 1, FIGS. 2A–2C and FIGS. 3A–3C.

The ink outlet portion 1 connected to the ink bag 3 is provided with a void 9 so as to be slidable in the x, y directions as shown in FIG. 2 within a predetermined range perpendicular to an axis of the ink cartridge container 5 when it is incorporated into the ink cartridge container 5. Accordingly, when the ink supply pipe 6 secured to the ink jet recording apparatus is deviated by, e.g., a distance l as shown in FIG. 3A off the center of the ink outlet portion 1 of the ink cartridge mounted along the guide rails 8*a*, 8*b*, the ink outlet portion 1 makes contact with the ink supply pipe 6 by moving the ink cartridge 5 to the side of the ink supply pipe 6, as shown in FIG. 3B. The ink cartridge having three ink bags 3 is configured so that respective coupling members 2 of the ink bags 3 are movable to achieve firm connecting states.

Herein, the ink outlet portion 1, which is of a conical shape continuously expanding in a direction toward the ink supply pipe 6, is movable in a direction of the arrow X in FIG. 3B together with the ink bag 3, owing to a void 9 disposed in the direction perpendicular to a container axis, and thus movable across a tip end of the ink supply pipe 6, so that the ink outlet portion 1 can move transversely in a natural manner to be aligned with a location of the ink supply pipe 6, as shown in FIG. 3C, finally resulting in coupling between the ink supply pipe 6 and the coupling member 2. Note that the dimensions of the void 9 for governing the movable range of the ink outlet portion 1 can be determined by totally judging the dimensional precisions of the ink supply pipe 6, the dimensional precisions of the ink cartridge container 5, and the attachment precisions therebetween. To reduce the force required to detach the ink cartridge from the .ink supply pipe 6, and to prevent the tearing of the coupling member 2, it is desirable that the coupling member 2 of the ink outlet portion 1 is preformed with a small coupling hole or a slit 2*a* as shown in FIG. 4.

Further, this embodiment is applicable to an ink cartridge of the construction in which the ink outlet portion 1 is comprised of a ball valve having a ball 10*a* and a spring 10*b*, as shown in FIG. 5.

Figure 6A:
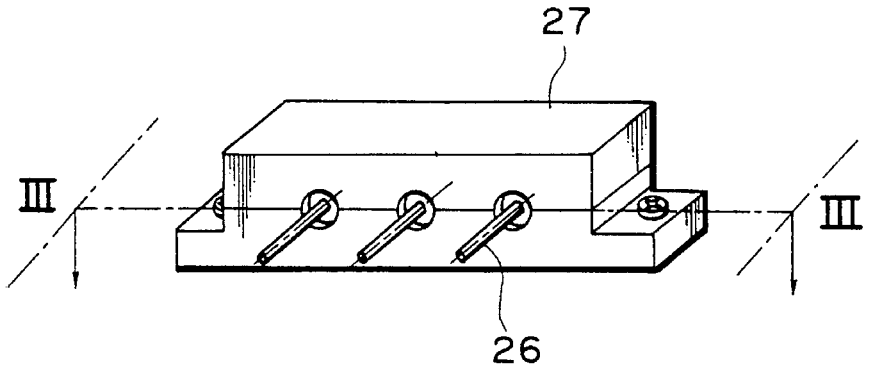
FIG. 6A is a perspective view illustrating supply pipes and a pipe fixing board.
Figure 6B:
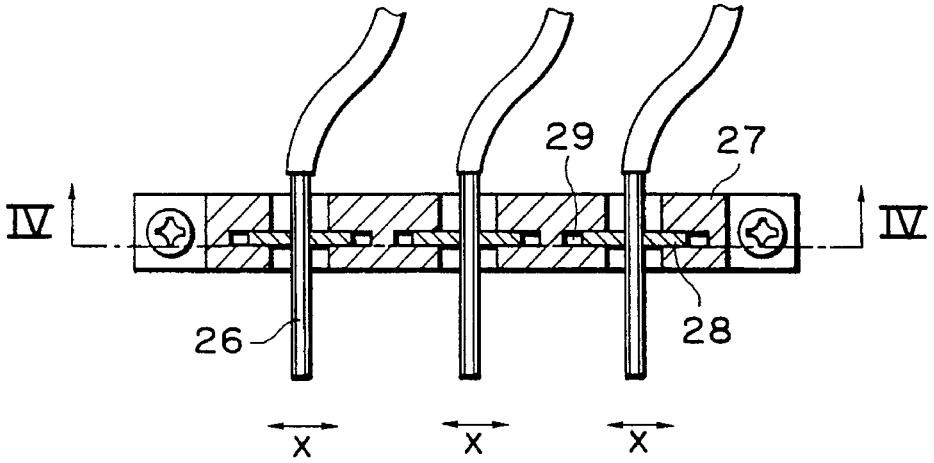
FIG. 6B is a cross-sectional view taken along the line II—II in FIG. 6A.
Figure 6C:
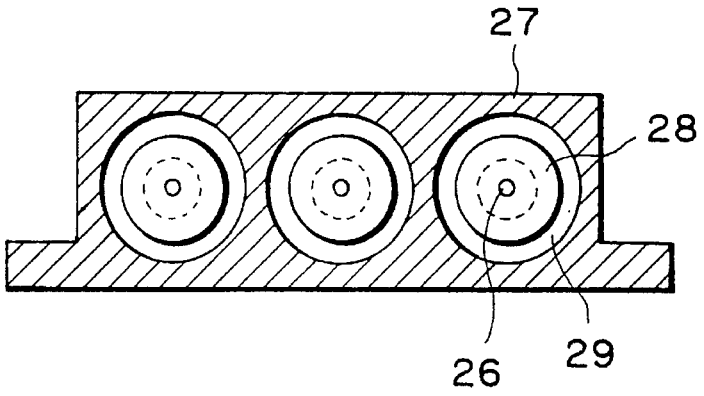
FIG. 6C is a cross-sectional view taken along the line IV—IV in FIG. 6B, where an ink supply pipe support member 28 is slidable within a predetermined range in the directions perpendicular to an axis thereof according to a second embodiment.

FIG. 6A is a perspective view illustrating ink supply pipes 26 and a pipe fixing board 27, FIG. 6B is a cross-sectional view taken along the line II—II in FIG. 6A, and FIG. 6C is a cross-sectional view taken along the line IV—IV in FIG. 6B, where the ink supply pipes 26 are slidable within a predetermined range in the directions perpendicular to an axis thereof, according to a second embodiment.

An ink supply pipe 26 is secured to a pipe support member 28, which is in turn secured to the pipe fixing board 27 to provide a void 29, as shown in FIGS. 6A and 6B.

Accordingly, when the ink cartridge having ink outlet portions (not shown) connected to ink vessels is mounted on the ink jet recording apparatus, the ink supply pipe 26 is moved within the void 29 along with the pipe support member 28 to be naturally aligned with the ink outlet portion, so that the ink supply pipe 26 is correctly positioned substantially at the center of the ink outlet portion and coupled therewith.

Figure 7:
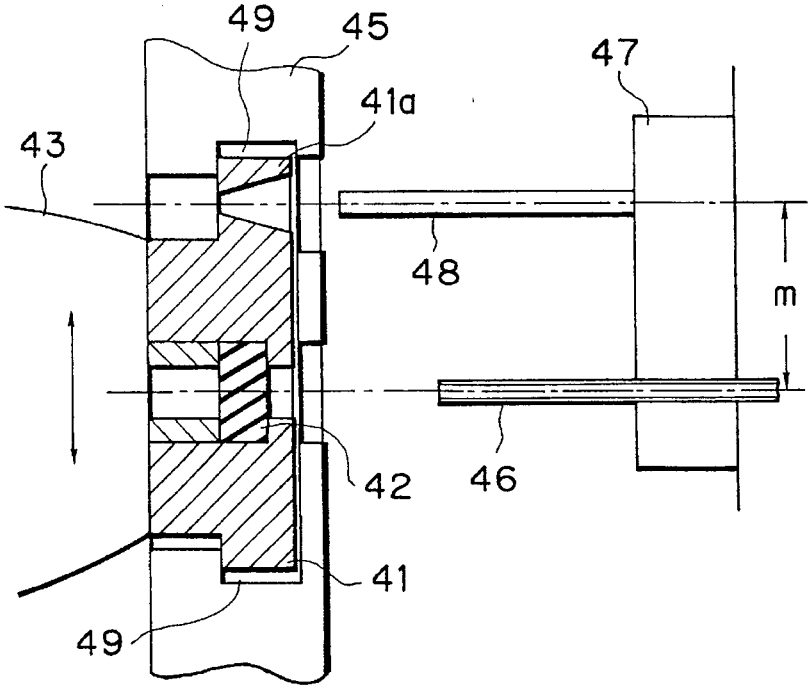
FIG. 7 is a cross-sectional view illustrating an ink outlet portion and an ink supply portion 47 where a gauge pin is provided in the ink supply portion and the ink outlet portion is slidable in the direction perpendicular to an axis thereof relative to an ink cartridge container according to a third embodiment.

FIG. 7 is a cross-sectional view illustrating an ink outlet portion 41 and an ink supply portion 47 in which a gauge pin 48 is provided in the ink supply portion 47, and the ink output portion 41 is slidable in the direction perpendicular to an axis of an ink cartridge container 45 according to a third embodiment.

The ink supply portion 47 has an ink coupling pipe 46 for delivering the ink from an ink bag 43 of ink cartridge and a guage pin 48 for positioning the ink outlet portion 41 of the ink cartridge, which are correctly positioned a distance m apart from each other and fixed therein. And the ink outlet portion 41 of the ink cartridge is provided with a void 49 so as to be movable within a predetermined range in the ink cartridge container 45, and has a coupling member 42 for coupling with the ink coupling pipe 46 embedded therein, and further at a position off the coupling member 42 not to prevent the coupling of the ink bag 43, it is provided with a receptacle 41*a* of a conical shape expanding continuously toward an opening into which the gauge pin 48 of the ink supply portion 47 is inserted.

That is, in coupling the ink cartridge with the ink coupling pipe 46, the receptacle 41*a* of conical shape in the ink outlet portion 41 first makes contact with the gauge pin 48 affixed to the ink supply portion 47 which is longer than the ink coupling pipe 46, and in accordance with the conical shape, the whole ink outlet portion 41 integrated with the ink bag 43 is caused to move within the void 49 to be in alignment with the gauge pin 48. And by further pushing in the ink cartridge, the ink coupling pipe 46 in right alignment with the gauge pin 48 is correctly aligned with the coupling member 42 of the ink outlet portion 41. This method has the advantage that as the ink outlet portion 41 is moved due to sliding contact between the gauge pin 48 and the conical portion 41*a*, reduced load is applied on the ink supply pipe 46, preventing any damage.

Figure 8:
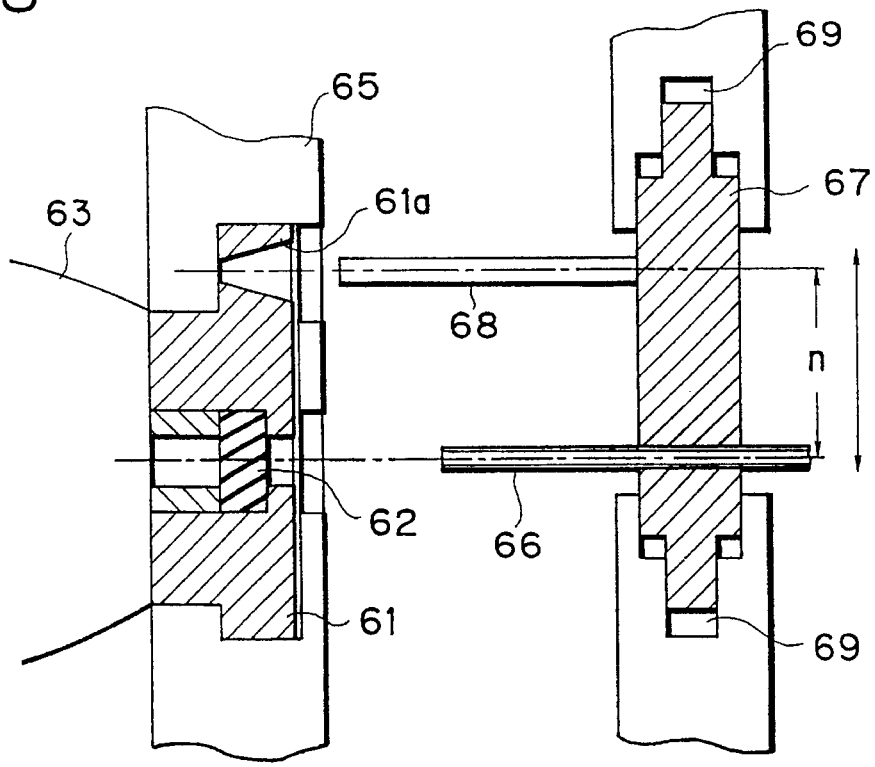
FIG. 8 is a cross-sectional view illustrating an ink outlet portion and an ink supply portion 67 where a gauge pin is provided in the ink supply portion, and the ink outlet portion is secured to an ink cartridge container while the ink supply portion is slidable according to a fourth embodiment.
Figure 9:
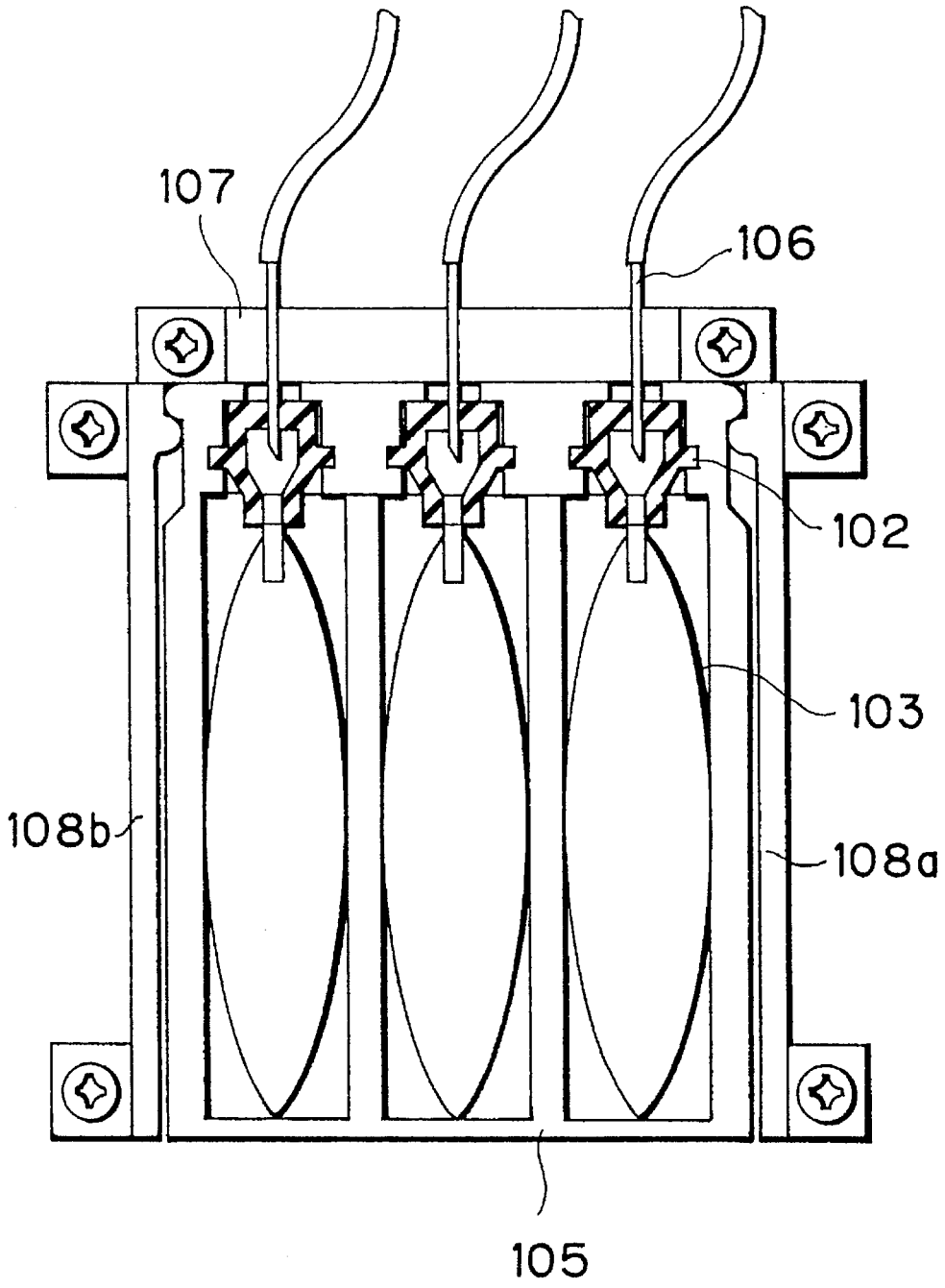
FIG. 9 is a plan cross-sectional view illustrating the couplings of ink outlet portions of an ink cartridge with ink supply pipes of a recording apparatus according to a conventional example.

FIG. 8 is a cross-sectional view illustrating an ink outlet portion 61 and an ink supply portion 67 in which a gauge pin 68 is provided in the ink supply portion 67 a distance n apart from an ink supply pipe 66, and the ink outlet portion 61 is fixed to an ink cartridge container 65, while the ink supply portion 67 is slidable, according to a fourth embodiment.

Where the ink outlet portion 61 is secured to the ink cartridge container 65, in attaching an ink cartridge through an ink supply pipe 66, a receptacle 61*a* of a conical shape in the ink outlet portion 61 abuts against a gauge pin 68 of the ink supply portion 67, which is then moved along the conical shape, so that the ink supply pipe 66 of the supply portion 67 is positioned substantially at the center of a coupling member 62 of the ink outlet portion 61 and secured therein. Of course, it will be appreciated that the ink supply portion on the ink cartridge side and the ink supply pipe on the apparatus side may be configured to be both slidable for the positioning. However, in this case, it is necessary that the amount of sliding be determined in consideration of the deviation caused by sliding.

Though the ink is considered as the liquid in the embodiments as above described, another ink may be also usable which is solid below room temperature and will soften or liquify at or above room temperature, or liquefy when a recording enable signal is issued as it is common with the ink jet device to control the viscosity of ink to be maintained within a certain range of the stable discharge by adjusting the temperature of ink in a range from 30° C. to 70° C.

In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquifying only with the application of heat energy, such as liquefying with the application of heat energy in accordance with a recording signal so that liquid ink is discharged, or may be solidified prior to reaching a recording medium, is also applicable in the present invention. In such a case, the ink may be held as liquid or solid in recesses or throughholes of a porous sheet, which is placed opposed to electricity-heat converters, as described in Japanese Laid-Open Patent Application No. 54-56847 or No. 60-71260. The most effective method for the ink as above described in the present invention is based on the film boiling.

Further, the recording apparatus according to the present invention may be provided, integrally or separately, as an image output terminal in the information processing equipment such as a word processor or a computer, or in the form of a copying machine in combination with a reader or a facsimile terminal equipment having the transmission and reception features.

As above described, the present invention provides an ink jet recording apparatus configured such that either one or both of an outlet portion of the ink cartridge and an ink supply portion of the ink supply line to be coupled with the outlet portion may be slidable readily toward the coupling position therebetween, and thereby can exhibit the effect that correct coupling of the ink cartridge with the ink supply portion is enabled even though the positioning precision of ink cartridge or ink supply portion as well as the component dimensional precision may be low, with a simple mechanism and reduced costs.

In particular, when there are provided a plurality of ink bags within an ink cartridge, each portion is slidable individually, whereby the positioning is effected more easily and securely.

Also, since a pipe having a blunt tip thereof can be employed for coupling of the ink supply portion, there is no need of a needle cover or cap so that the ink jet recording apparatus can be made smaller in effect.

What is claimed is:

1. An ink jet apparatus having an ink cartridge mounting section removably receiving an ink cartridge for storing ink to be supplied to a recording head, said section comprising:

ink supply path defining means insertable into an ink outlet member in an ink containing section of the ink cartridge for receiving ink therefrom; and a support member for supporting said ink supply path defining means, wherein said ink supply path defining means is loosely fitted into and supported by said support member within a predetermined space, said ink supply path defining means being movable in a direction transverse to an axis of an insertion direction of the ink outlet member.

2. An apparatus according to claim 1, capable of mounting an ink cartridge integrally storing a plurality of ink containers and further comprising a plurality of tubular ink supply path means independently loosely fitted into and supported by said support means.

* * * * *

UNITED STATES PATENT AND TRADEMARK OFFICE

CERTIFICATE OF CORRECTION

PATENT NO. : 5,523,780

DATED : June 4, 1996

INVENTOR(S) : TOSHIAKI HIROSAWA ET AL.

It is certified that error appears in the above-identified patent and that said Letters Patent is hereby corrected as shown below:

COLUMN 1

Line 20, "type" should be deleted.

COLUMN 3

Line 22, "II-II" should read --III-III--.

COLUMN 5

Line 7, "II-II" should read --III-III--.

Signed and Sealed this

First Day of October, 1996

Bruce Lehman

*Attest:*

BRUCE LEHMAN

*Attesting Officer*

*Commissioner of Patents and Trademarks*